US005836458A

United States Patent [19]

Nales

[11] Patent Number: 5,836,458

[45] Date of Patent: Nov. 17, 1998

[54] METHOD FOR MANUFACTURING A DEVICE IN WHICH DISH-SHAPED CONTAINERS CAN BE PLACED AND A DEVICE IN WHICH DISH-SHAPED CONTAINERS CAN BE PLACED

[76] Inventor: Arnoldus Theodorus Bernardus Maria Nales, Vollehandsweg 2, 7396 B.W., Terwolde, Netherlands

[21] Appl. No.: 793,732

[22] PCT Filed: Oct. 6, 1995

[86] PCT No.: PCT/NL95/00340

§ 371 Date: Mar. 4, 1997

§ 102(e) Date: Mar. 4, 1997

[87] PCT Pub. No.: WO96/11603

PCT Pub. Date: Apr. 25, 1996

[30] Foreign Application Priority Data

Oct. 18, 1994 [NL] Netherlands ..... 9401715

[51] Int. Cl.[6] ..... A47F 5/00

[52] U.S. Cl. ..... 211/41.2; 211/71.01; 211/205

[58] Field of Search ..... 211/41.1, 41.2, 211/41.3, 71.01, 205

[56] References Cited

U.S. PATENT DOCUMENTS 4,911,308 3/1990 Nylund ..... 211/41.2 X 5,088,605 2/1992 Nales ..... 211/205 X 5,538,145 7/1996 Held ..... 211/41.2 X

FOREIGN PATENT DOCUMENTS 2613163 10/1977 Germany ..... 211/41.2

4031308 4/1992 Germany ..... 211/41.2

*Primary Examiner*—Robert W. Gibson, Jr.

*Attorney, Agent, or Firm*—Brooks & Kushman P.C.

[57] ABSTRACT

A device, and a method for making the device, for supporting and storing dish-shaped containers. The device has a column with side faces intersecting to form therebetween corners having specific angles. Vertical, nonreleasing slits are formed in the side faces. Strips having pin-shaped projections extending therefrom slidably fit within the slits so that the projections extend away therefrom. Slits are also defined at the corners of the column. Strips having a centrally disposed longitudinal groove about which the strip is bent at the specific angle of each corner are inserted into the nonreleasing slits disposed at the corners. All pin-shaped projections extending away from a given side face therefore extend in the same direction.

7 Claims, 2 Drawing Sheets

METHOD FOR MANUFACTURING A DEVICE IN WHICH DISH-SHAPED CONTAINERS CAN BE PLACED AND A DEVICE IN WHICH DISH-SHAPED CONTAINERS CAN BE PLACED

BACKGROUND OF THE INVENTION

The invention relates to a method for manufacturing a device in which dish-shaped containers, such as plates, dishes or serving trays, can be placed at a desired mutual distance above one another, which device consists of a column which has supporting elements disposed at the desired distance above one another, for the accommodation of the containers in the horizontal position, in which each supporting element consists of a number of pin-shaped projections, a column to which elements are fixed being manufactured first, and said elements being provided with pin-shaped projections projecting in the same direction.

The invention also relates to a device in which dish-shaped containers, such as plates, dishes or serving trays, can be placed at a desired mutual distance above one another, which device consists of a column which has supporting elements disposed at the desired distance above one another, for the accommodation of the containers in the horizontal position, in which each supporting element consists of a number of pin-shaped projections which are fixed to the column by means of elements.

Such a device is known from, for example, European Patent EP-0,432,813. The device described therein consists of a vertical column with a base. The column has a triangular or rectangular cross-section, while pin-shaped projections are disposed on each side. Two projections always lie in line with each other in the horizontal direction, and a third pin-shaped projection which is longer than the other two projections lies in the centre below the other two projections at a certain distance below the line connecting the other two projections to each other. Fitted at the ends of the pin-shaped projections are moulded pieces corresponding to the shape of the edges and the underside respectively of the plates or dishes stored in the device.

Such devices are difficult to manufacture, on account of the large number of projections projecting in different directions. The shape is non-releasing, so that moulding methods such as injection moulding have to be carried out with very complex and expensive moulds. The device therefore has to be assembled from a large number of individual parts. Due to the large number of different parts and the amount of assembly work required to assemble the device, the manufacture of such a device has been very expensive until now.

SUMMARY OF THE INVENTION

The object of the invention is a method for manufacturing a device in which dish-shaped containers can be stored, in which the device can be assembled as simply as possible at the lowest possible cost. Another object of the invention is a device which can be manufactured simply, quickly and cheaply.

This object is achieved by the invention through the fact that the elements are manufactured as strips which are integral with the projections, and through the fact that non-releasing blind slits are disposed in the side walls of the column, which slits have essentially the same cross-section as the strips, and through the fact that the strips with the projections are pushed into the slits. This means that a large number of projections can be manufactured in one go and disposed on the column, while the column itself can be a shape which is simple to manufacture, where the main shape with the slits can be extruded, for example, in one operation. Due to the fact that the projections project in one direction on each strip, the strips are a releasing shape, so that the strips are easy to make, for example by injection moulding. Both the column and the strips can be moulded by means of simple and readily controllable processes using simple moulds, and can be assembled easily and cheaply.

In a preferred embodiment the column is provided with several side faces which are at an angle with each other, a part of the non-releasing slits is disposed on the corners between the side faces, and strips are produced, while a groove is disposed in the lengthwise direction of the strips, and the strips are provided with projections projecting in the same direction at both sides of the groove, following which the strips are bent around the groove through an angle which corresponds to the angle between the side faces of the column, and the strips are then pushed into the slits on the corners. This makes it possible to manufacture a device in which the projections are disposed close to the corners, so that the column can be made narrow. Although the projections on the strip, when assembled, project in different directions, the strips can still be manufactured in a releasing form. Only after bending about the V-shaped groove do the projections project in different directions, and only then can the strip be pushed into the corresponding recess in the column.

In a preferred embodiment several short strips are pushed into each slit, while the distance between the first end of the strip and the closest projection together with the distance between the other end and the closest projection to it is the same as the distance between two adjacent projections on a strip. This means that in the case of different embodiments of the device to be manufactured in different heights a standard measurement can be taken for the strips, so that said strips can be manufactured in fairly large quantities, and thus more cheaply. The distance between two adjacent projections of two successive strips is in this case equal to the distance between two adjacent projections on the same strip.

The object of the invention is also achieved with a device in which dish-shaped containers, such as plates, dishes or serving trays, can be placed at a desired mutual distance above one another, which device consists of a column which has supporting elements disposed at the desired distance above one another, for the accommodation of the containers in the horizontal position, in which each supporting element consists of a number of pin-shaped projections which are fixed to the column by means of elements, the elements being strips which are integral with the projections, and non-releasing blind slits being disposed in the side walls of the column, into which slits the strips are pushed. Such a device can be assembled quickly and simply from basic parts which are simple to manufacture.

In a preferred embodiment the column has several side faces situated at an angle to each other, while a part of the non-releasing slits is disposed on the corners between the side faces, and an equally large part of the strips is bent through an angle around a groove running in the lengthwise direction near the centre of the strip, which angle corresponds to the angle between the side faces of the column. Due to the fact that the strips with the projections are disposed on the corner in this case, the projections are situated near the edges of the column, and the column can be of slim design.

In a further preferred embodiment a non-releasing projection is disposed in the non-releasing slits on the corners of the column, and the groove in the strips is disposed in a recess of such width that, after bending of the strips, the recess has the same cross-section as the non-releasing projection. This means that the strip is fixed better to the column, and the strip is more difficult to remove from the column.

BRIEF DESCRIPTION OF THE DRAWINGS

The invention will now be explained in greater detail with reference to the drawing, in which.

DESCRIPTION OF THE PREFERRED EMBODIMENT

Figure 1:
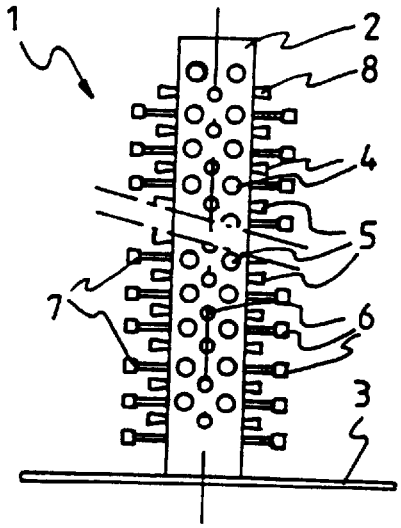
FIG. 1 shows in front view a device according to the invention.

FIG. 1 shows a device 1 for storing dish-shaped containers, such as dishes, plates or serving trays. The device 1 consists of a column 2 with a base 3. The column 2 is provided with supporting elements 4, in which the plates or dishes can be placed. The supporting elements 4 consist of two short projections 5 lying on a horizontal line and a longer projection 6 lying at a distance below the centre of the line connecting the two short projections to each other. Moulded pieces 7 are disposed on the ends of the projections 6, which moulded pieces match the shape of the plate or dish to be supported. Moulded pieces 8 are placed over the projections 5, covering the projections 5 completely and being a conical shape, with the same angle as the angle of the edges of the plates or dishes to be supported.

Figure 2:
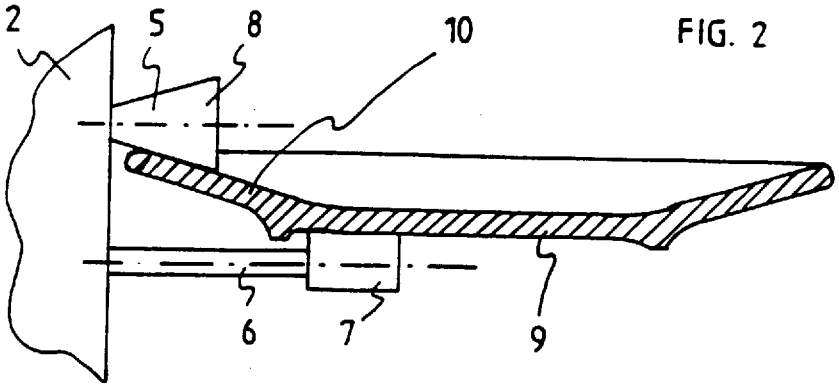
FIG. 2 shows in detail a supporting element of a device according to FIG. 1 with a dish.

FIG. 2 shows in detail how a plate 9 can be placed in the device 1. The underside of the plate 9 rests on a moulded piece 7 at the end of a long projection 6. The plate 9 is held further in the horizontal position by two adjacent short projections 5. Said short projections 5 are provided with an essentially conical moulded piece 8 with an angle matching the angle of the edge 10 of the plate 9.

Figure 3:
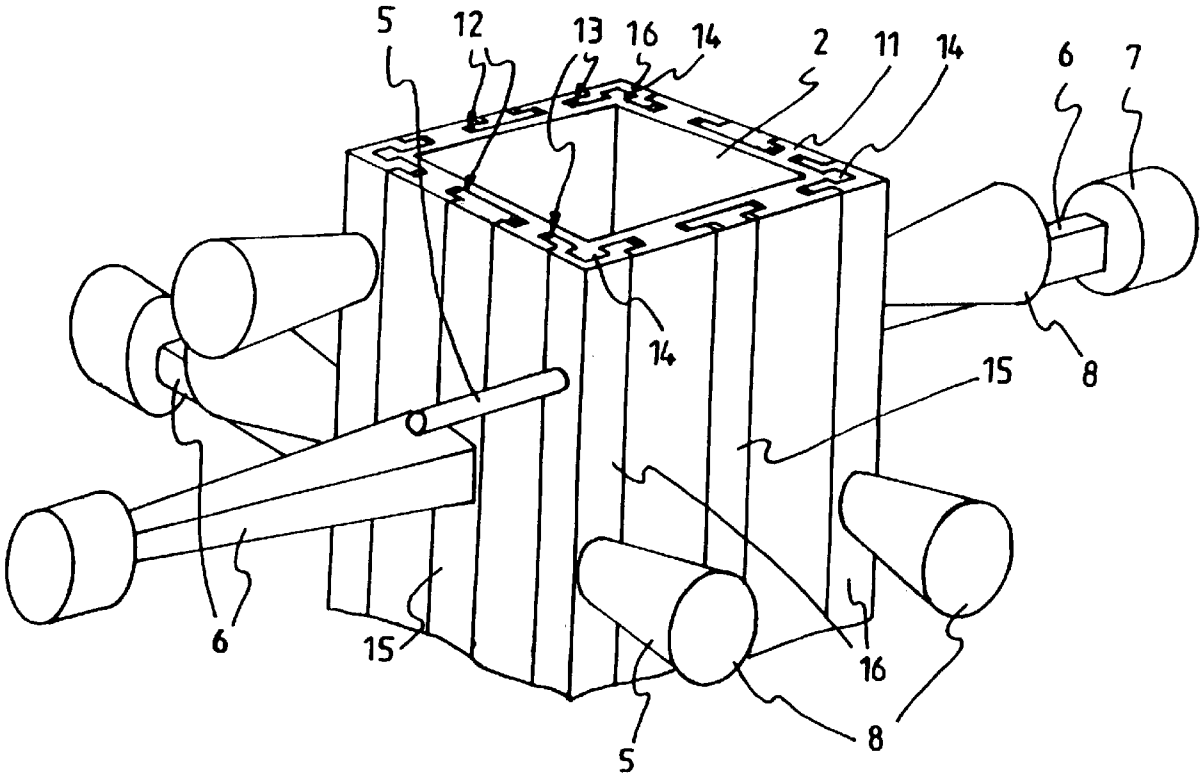
FIG. 3 shows in perspective the top side of a device according to FIG. 1.

FIG. 3 shows in perspective the top side of the device 1 from the previous figures. The column 2 has a square cross-section and consists of an extruded basic section 11 in which non-releasing, T-shaped blind slits 12 are disposed. Non-releasing V-shaped slits 13 are disposed on the corners, both legs of the V-shape running on into the side walls of the column 2 adjoining the corner. A non-releasing projection or ridge 14 is disposed in the slit 13 on the corner. Elements or strips 15 are pushed into the slits 12. The long projections 6, which are provided with the moulded pieces 7 at their ends, are disposed on the strips 15. Strips 16 are pushed into the V-shaped slits 13 on the corners of the column 2, on which strips two rows of short pin-shaped projections 5 are disposed, staggered relative to each other. The projections 5 in one row on a strip 16 project in a different direction from the projections in the other row. The projections 5 are provided with moulded pieces 8.

Figure 4:
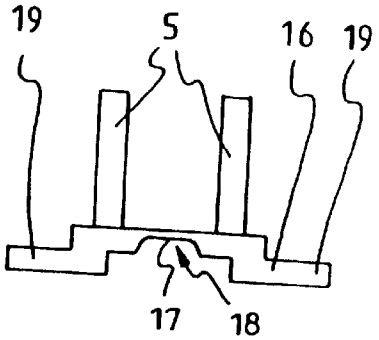
FIG. 4 shows a top view of an unbent strip for a device according to FIG. 1.
Figure 5:
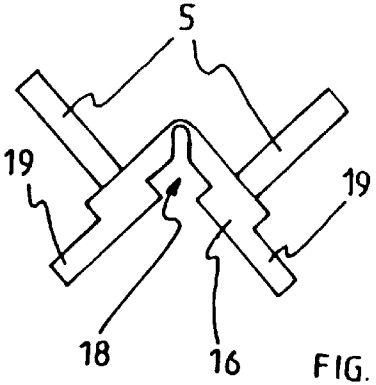
FIG. 5 shows a top view of a bent strip according to FIG. 4.

FIG. 4 shows the top view of a strip 16, as manufactured. The projections 5, distributed over two rows, all project in the same direction. For the remainder of the shape also, the strip 16 is fully releasing in shape. In the centre the strip 16 is provided with a V-shaped or U-shaped groove or film hinge 17. Said groove is disposed in a recess 18 which is broader than the groove. On either side the strip 16 has narrowed ends 19, which can be pushed into the slits 13 on the corners of the column 2. The strip 16 can be bent over along the groove 17 to the position shown in FIG. 5. When bent over, the strip 16 can be pushed into the recesses 13 on the corners of the column 2. The projections 5 of one row in this case lie at an angle with the projections 5 of the other row. When the strip 16 is bent over, the recess 18 is the same shape as the non-releasing projection 14 in the recess 13.

I claim:

1. A method for manufacturing a device in which dish-shaped containers can be placed and supported at a desired mutual distance above one another, the method including the steps of:

(a) fabricating a column having a plurality of side faces defining corners therebetween, each corner being formed at a specific angle, at least one side face having defined therein at least one vertically disposed nonreleasing slit;

(b) fabricating a plurality of strips at least a portion of each of which is slidably insertable within at least one of the nonreleasing slits, each of the plurality of strips having a plurality of pin-shaped projections extending in the same direction therefrom and being integrally formed therewith; and (c) inserting the plurality of strips into the plurality of nonreleasing slits.

2. The method as defined by claim 1, wherein:

step (a) further includes fabricating a column having a vertically disposed nonreleasing slit defined at each corner thereof; and step (b) further includes fabricating a strip having a centrally disposed longitudinal groove about which the strip is bent at the specific angle of a corner before the strip is inserted into the nonreleasing slit disposed at that corner, whereby all pin-shaped projections extending away from a given side face extend in the same direction.

3. The method as defined by claim 1, wherein step (b) includes fabricating strips the lengths of which are less than that of the column, and wherein the longitudinal distance between projections is twice the distance between an end of a strip and the nearest projection thereof.

4. The method as defined by claim 2, wherein step (b) includes fabricating strips the lengths of which are less than that of the column, and wherein the longitudinal distance between projections is twice the distance between an end of a strip and the nearest projection thereof.

5. A device in which dish-shaped containers can be placed and supported at a desired mutual distance above one another, the device comprising:

a column having a plurality of side faces defining corners therebetween, each corner being formed at a specific angle, at least one side face having defined therein at least one vertically disposed nonreleasing slit;

a plurality of strips at least a portion of each of which is slidably insertable within at least one of the nonreleasing slits, each of the plurality of strips having a plurality of pin-shaped projections extending in the same direction therefrom and being integrally formed therewith.

6. The device as defined by claim 5, wherein:

the column has a vertically disposed nonreleasing slit defined at each corner thereof;

the device further includes a strip having a centrally disposed longitudinal groove about which the strip is bent at the specific angle of a corner before the strip is inserted into the nonreleasing slit disposed at that corner, whereby all pin-shaped projections extending away from a given side face extend in the same direction.

7. The device as defined by claim 6, wherein the strips have lengths that are less than that of the column, and wherein the longitudinal distance between projections is twice the distance between an end of a strip and the nearest projection thereof.

* * * * *